US006568170B1

(12) United States Patent
Rives

(10) Patent No.: US 6,568,170 B1
(45) Date of Patent: May 27, 2003

(54) ROCKET WITH HIGH PRESSURE FUELING MODULE

(75) Inventor: William D. Rives, Seattle, WA (US)

(73) Assignee: Scientific Explorer, Inc., Seattle, WA (US)

( * ) Notice: Subject to any disclaimer, the term of this patent is extended or adjusted under 35 U.S.C. 154(b) by 0 days.

(21) Appl. No.: 09/501,126

(22) Filed: Feb. 9, 2000

(51) Int. Cl.[7] ..... A63H 27/00
(52) U.S. Cl. ..... 60/221; 124/57; 446/212
(58) Field of Search ..... 60/200.1, 204, 60/205, 219, 221; 124/57; 446/56, 211, 212; 215/360

(56) References Cited

U.S. PATENT DOCUMENTS 624,363 A * 5/1899 Moore
2,479,862 A * 8/1949 Payne
2,759,297 A * 8/1956 Lewis
2,918,751 A * 12/1959 Johnson
3,046,694 A * 7/1962 Holderer
5,188,557 A * 2/1993 Brown
5,839,940 A * 11/1998 Ensmenger
5,881,706 A * 3/1999 Carson

* cited by examiner

*Primary Examiner*—Michael Koczo
(74) *Attorney, Agent, or Firm*—Bruce A. Kaser; Davis Wright Tremaine LLP

(57) ABSTRACT

A rocket with a high pressure propellant module, comprising a toy bottle rocket that uses gases generated from the reaction between baking soda and vinegar. A mechanism controls the release of the gas formed by the chemical reaction and allows the gas to reach a high pressure inside the rocket prior to release.

1 Claim, 2 Drawing Sheets

ROCKET WITH HIGH PRESSURE FUELING MODULE

BACKGROUND OF THE INVENTION

The present invention generally relates to model rockets powered by the chemical reaction of baking soda and vinegar.

Most high performance model rockets today are powered by solid fuels that provide propulsion as they burn. Baking soda and vinegar can also be used as a model rocket propelling agent. A typical baking soda and vinegar rocket consists of a plastic bottle and stopper, and often paper or balsa wood fins. To launch such a rocket, the user pours baking soda and vinegar into the bottle and quickly pushes the stopper in the bottle mouth. The chemicals react to form carbon dioxide gas, and the rocket is propelled into the sky when the pressure inside the bottle forces the stopper out. These rockets make good children's toys and teachers use them to illustrate chemical reactions, Newton's laws of motion and other scientific principles.

The present invention enables a toy rocket to climb 27.43 m (90 ft) to 30.48 m (100 ft) and more. The high pressure in the fueling module allows the gas inside the bottle to build to a much higher pressure before it is released, thereby generating greater thrust. The module also enables the user to control commencement of the chemical reaction, and to adjust the pressure level at which the launch will occur. These features result in impressive high altitude flights that children will enjoy and educators will find valuable in the classroom.

BRIEF SUMMARY OF THE INVENTION

The present invention is a toy bottle rocket that uses gases generated from baking soda and vinegar as a propelling agent.

In a preferred embodiment of the invention, a toy bottle rocket uses a mixture of baking soda and vinegar to produce a propellant gas. The bottle rocket comprises a bottle having a bottle mouth opening, an elongated tube separate from the bottle, for holding baking soda while the tube is inserted into the mouth of the bottle. The tube has opposite end openings and an outer diameter that is less than the diameter of the bottle's mouth opening. A stopper member assembly has an end portion that is at least partially inserted into one open end of the tube, for closing that end of the tube and connecting the tube to the stopper member assembly.

Advantages over the art include achievement of higher altitude by toy bottle rockets using safe, nonflammable, non toxic propelling agents, namely baking soda and vinegar. The present invention also enables efficient utilization of the gases generated by the reaction of baking soda and vinegar.

The invention will best be understood by reference to the following detailed description of the preferred embodiment, taken in conjunction with the accompanying drawings. The discussion below is descriptive, illustrative and exemplary and is not to be taken as limiting the scope defined by any appended claims.

DETAILED DESCRIPTION OF THE BEST MODE

Figure 1:
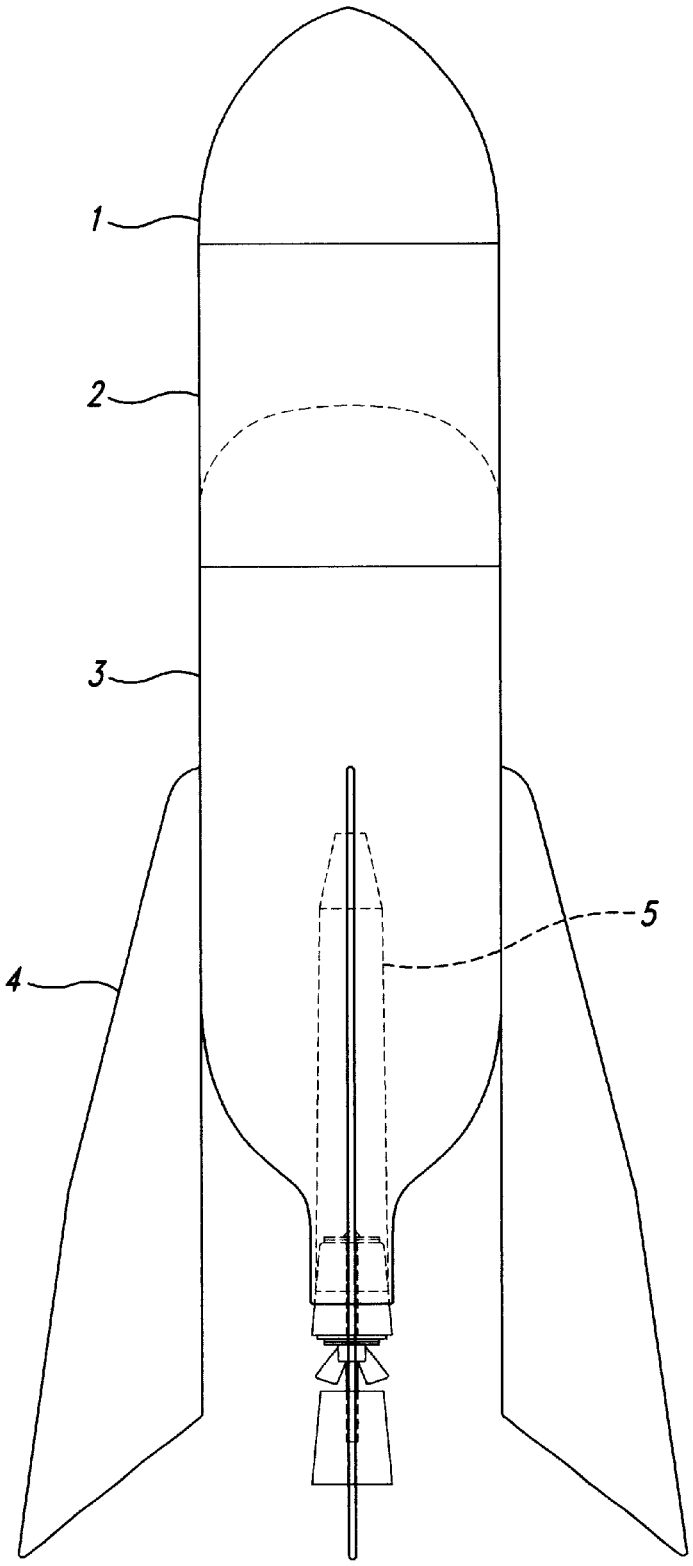
FIG. 1 is a frontal view of a toy bottle rocket embodying principles of the present invention in a preferred embodiment.

The components of the rocket shown in FIG. 1 can be glued or taped together. The nose cone 1 is made of 0.030 styrene plastic with a diameter of 8.25 cm (3.25 in) and a length of 6.35 cm (2.5 in). The nose cone is attached to a fuselage extension 2 that is 8.89 cm (3.5 in) long and made of red acetate film. The fuselage extension slips over the end of a plastic bottle 3 about 4.45 cm (1.75 in) and is glued or taped in place. The plastic bottle is generally a one liter PET plastic bottle commonly used as a container for carbonated water and soft drinks. The fins 4, cut from 0.16 cm (0.0625 in) balsa wood and covered with an adhesive backed mirror coated plastic film, are glued or taped to the bottle.

Figure 2:
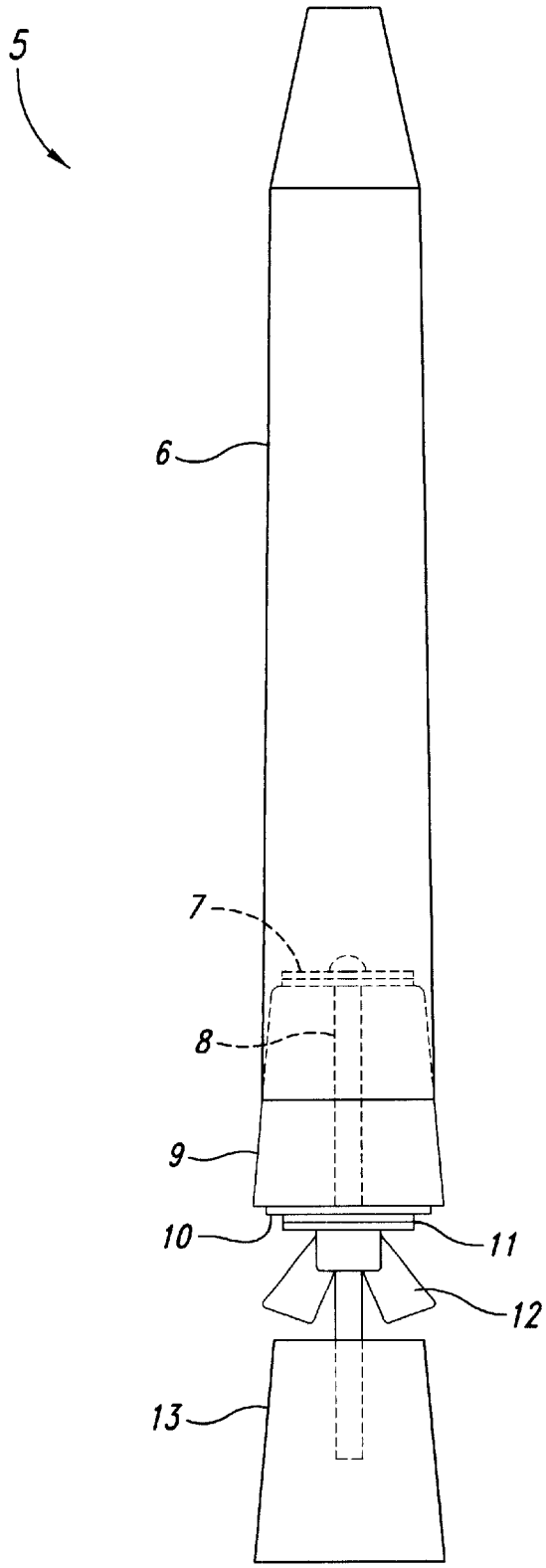
FIG. 2 is an enlarged view of the inner tube and stopper member assembly used to control the reaction of baking soda and vinegar and increase the pressure inside the toy rocket.

FIG. 2 shows the components of high pressure propelling module 5. The high pressure propelling module is assembled by slipping the following parts over the 5.72 cm (2.25 in) screw 8 (screw size should be No. 12 or 13) in the following order: bonded sealing washer 7, rubber stopper 9, flat washer 10, bonded sealing washer 11, wing nut 12 and rubber stopper 13. The tube 6 is a 15 ml plastic centrifuge tube with the tip cut off that slips over the bonded sealing washer and rubber stopper 9 (which holds it in place) as shown in FIG. 2. The components of module 5 are held in place by tightening the wing nut 12, which tightens the stopper 9 and washer 7 assembly. The end of the screw 8 is inserted into the second rubber stopper 8. The second rubber stopper 13 stabilizes the rocket so that it can be placed firmly on the ground without toppling over.

The rocket is charged and launched in the following manner. The rocket is turned upside down and filled with vinegar until the bottle is filled to a depth of 4.45 cm (1.75 in). The centrifuge tube is filled with baking soda and slipped over bonded sealing washer on the high pressure propelling module. With the rocket held horizontally, the user inserts the high pressure propelling module into the bottle mouth opening. After pushing the stopper in snugly, the user tightens the wing nut three to six half turns. This action compresses the length of the stopper and expands its circumference, which in turn increases the friction between the stopper and the bottle. Then the user turns the nose down to empty the baking soda out of the centrifuge tube into the vinegar. This starts the chemical reaction inside the bottle. When the user places the rocket on the ground the gas forms inside the bottle and pressure builds up until it is high enough to push out the stopper, sending the rocket up into the sky.

I claim:

1. A toy bottle rocket that uses a mixture of baking soda and vinegar to produce a propellant gas, the bottle rocket comprising:

a bottle having a bottle mouth opening;

an elongated tube, separate from the bottle, for holding baking soda while the tube is inserted into the mouth of the bottle, the tube having opposite end openings and an outer diameter that is less than the diameter of the bottle's mouth opening;

a stopper member assembly having an end portion that is at least partially insertable into one open end of the tube, for closing that end of the tube and connecting the tube to the stopper member assembly, the stopper member assembly further including means for compressing another portion of the stopper member assembly along a lengthwise axis, to thereby expand the circumference of the stopper member assembly outwardly against the mouth opening of the bottle after the combined stopper member assembly and tube are together inserted into the mouth opening of the bottle, for increasing the friction between the stopper member assembly and the mouth opening, and to thereby create a higher resistance to gas pressure build-up inside the bottle when the baking soda is mixed with the vinegar.

* * * * *